US007344635B2

(12) United States Patent
Briot et al.

(10) Patent No.: US 7,344,635 B2
(45) Date of Patent: Mar. 18, 2008

(54) INTEGRAL METHOD FOR DESULPHURIZATION OF A HYDROCARBON CRACKING OR STREAM CRACKING EFFLUENT

(75) Inventors: Patrick Briot, Pommier de Beaurepaire (FR); Pierre Boucot, Ternay (FR); Alain Forestiere, Vernaison (FR); Nathalie Marchal-George, Saint Genis Laval (FR); Florent Picard, Saint Symphorien D'Ozon (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 347 days.

(21) Appl. No.: 10/503,807

(22) PCT Filed: Jan. 22, 2003

(86) PCT No.: PCT/FR03/00203

§ 371 (c)(1),
(2), (4) Date: Jun. 13, 2005

(87) PCT Pub. No.: WO03/066778

PCT Pub. Date: Aug. 14, 2003

(65) Prior Publication Data

US 2005/0230286 A1 Oct. 20, 2005

(30) Foreign Application Priority Data

Feb. 7, 2002 (FR) ..... 02 01531

(51) Int. Cl.
*C10G 45/02* (2006.01)

(52) U.S. Cl. ..... 208/208 R; 208/209; 208/218

(58) Field of Classification Search ..... 208/208 R, 208/209, 218

See application file for complete search history.

(56) References Cited

U.S. PATENT DOCUMENTS

| | | | |
|---|---|---|---|
| 5,599,441 | A | 2/1997 | Collins et al. |
| 5,863,419 | A | 1/1999 | Alexander et al. |
| 6,024,865 | A | 2/2000 | Alexander et al. |

FOREIGN PATENT DOCUMENTS

| | | |
|---|---|---|
| EP | 1 077 247 | 2/2001 |
| WO | WO 01 96498 | 12/2001 |

*Primary Examiner*—Tam M. Nguyen
(74) *Attorney, Agent, or Firm*—Millen, White, Zelano & Branigan, P.C.

(57) ABSTRACT

Process for desulfurization of an effluent for cracking or steam-cracking hydrocarbons, more particularly a gasoline for example for catalytic cracking that comprises the elimination of thiophenic compounds by alkylation of these compounds, followed by a distillation, a hydrocracking of said alkyl-thiophenic compounds, then a hydrodesulfurization of the effluent that is obtained from the hydrocracking zone. In a preferred embodiment, this process comprises a preliminary stage for separating the cracking or steam-cracking effluent into three fractions, and proposes sending to the alkylation stage only the intermediate fraction that is low in heavy basic nitrogen-containing compounds that are initially present in the effluents that are to be alkylated.

19 Claims, 1 Drawing Sheet

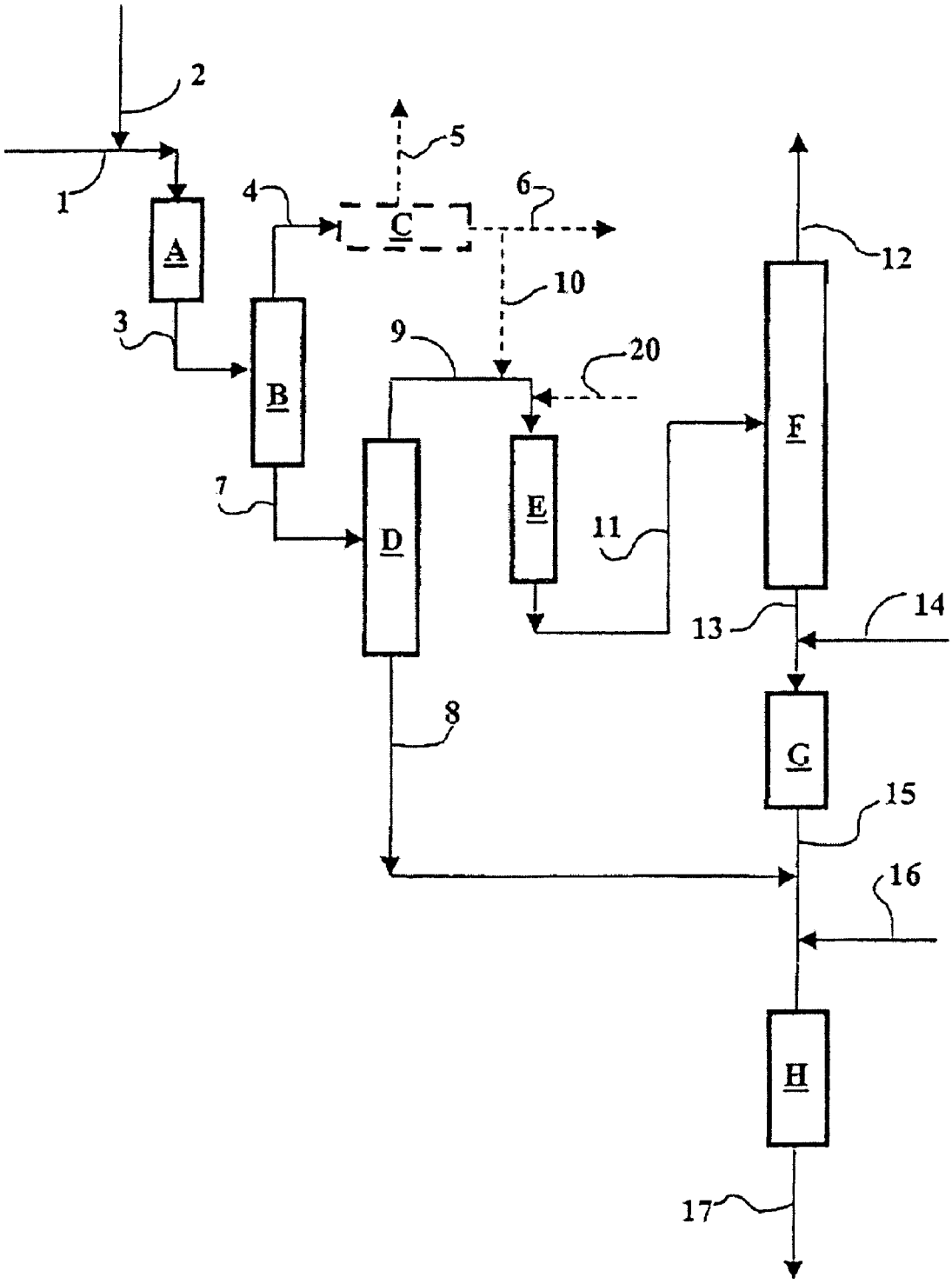
2
1
A
3
B
4
C
5
6
10
9
20
7
D
E
11
F
12
13
14
G
8
15
16
H
17

INTEGRAL METHOD FOR DESULPHURIZATION OF A HYDROCARBON CRACKING OR STREAM CRACKING EFFLUENT

This invention relates to a process for desulfurizing hydrocarbon-containing fractions that contain olefins and sulfur, at least partially in the form of thiophenic or benzothiophenic compounds. Usually, the olefin content of the hydrocarbon-containing fractions that it is desired to desulfurize is at least 3% by weight, and the contents of these fractions in thiophenic or benzothiophenic compounds is at least higher than 5 ppm and can go up to 3% by weight of sulfur.

The final boiling point of the hydrocarbon-containing fraction that is usually treated within the framework of this invention is generally less than or equal to 350° C. This fraction can contain benzene. It is therefore most often a gasoline fraction that is obtained either totally or partially (preferably at least 10% by weight) from any hydrocarbon conversion process that is known to one skilled in the art.

The feedstock is generally selected from the group that consists of the effluents from a catalytic cracking unit, a steam-cracking unit or a coke production unit (coking according-to the English terminology).

According to the invention, it relates to, in particular, the gasolines that are obtained from the cracking processes (most often a catalytic cracking process) that in France usually constitute about 40% by weight of the gasoline mixture that is stored in the refinery, "pool according to English terminology." They are more particularly advantageous because they have high contents of olefinic-type unsaturated hydrocarbons. These olefins impart high octane numbers to these gasolines. However, they have a sometimes high content of sulfur that is often between 0.05% and 1% by weight. In European specifications, the sulfur content in the gasolines for marketing should not exceed 50 ppm by weight, and even 10 ppm by weight in the near future.

To reach this goal, a standard hydrodesulfurization process is most often used. This process, well known to one skilled in the art, consists in hydrogenating these products so as to eliminate the sulfur in gaseous form or $H_2S$. The drawback of the various hydrodesulfurization processes that are currently used is that they also hydrogenate the olefins regardless of the catalysts that are used. This hydrogenation of olefins is reflected by a lowering of the octane number, a very important property for the refiner.

The process of this invention comprises a stage that has as its object to selectively increase the weight of the sulfur-containing compounds that are contained in these gasolines, thus making it possible to separate them from the olefins by distillation. The only thing that remains to do then is to treat a fraction that is high in sulfur and low in olefins by a hydrogen-containing gas. The other fraction (lighter) that is low in sulfur and that contains olefins does not undergo hydrogenation and therefore keeps its anti-detonation properties.

This invention can make it possible not to initiate the preliminary elimination of nitrogen-containing compounds, generally basic, that are present in the feedstocks that are to be treated, by an acid washing or by use of a guard bed. The presence of such compounds made it necessary, either in using another type of scheme or in particular in the case where it is desired to eliminate the thiophene or the thiophenic compounds, to remove these basic nitrogen-containing compounds by an acid washing or by use of a guard bed that usually contains a specific adsorbent.

The diagram of FIG. 1 is present to be used as an example and to explain the operating principle of a particular embodiment of the process of the invention.

The gasoline (or α) that can contain diolefins is injected via line 1 into a unit (A) for hydrogenation of diolefins. This stage a), as well as stage c), described below, are optional stages if the feedstock is lacking in diolefins. The hydrogen is injected via line 2. The feedstock and the hydrogen are brought into contact with a hydrogenation catalyst. This stage for hydrogenation of diolefins is known to one skilled in the art. During this stage a), an at least partial elimination of light sulfur-containing compounds, such as the mercaptans, having a boiling point that is less than that of thiophene, often takes place by the addition of these compounds to the olefinic compounds that are present in the feedstock that is to be treated.

After the hydrogenation, effluent 3 is sent into a separation unit B (stage b)) that can be an evaporation tank, a separation column that provides a top product and a bottom product (in English: splitter) or a distillation column so as to separate the effluents into at least two fractions:

- a so-called light fraction 4 (or β) whose boiling points are often less than 60° C. This temperature is provided by way of indication; it is actually preferably the maximum temperature for which the sulfur content of the light fraction is less than 50 ppm by weight,
- a so-called heavy fraction 7 (or γ) whose boiling points are higher than those of fraction β, therefore usually higher than 60° C.

Light fraction β is then injected into a gas/liquid separation zone (stage c)) such as, for example a gas/liquid separation tank, so as to separate:

- a gaseous fraction that contains unconsumed hydrogen and $H_2S$ if it is formed from it during stage a), evacuated via line 5,
- a fraction that contains olefins that usually have at least 5 carbon atoms in their molecule and generally 5 to 7 carbon atoms, evacuated via line 6.

For example, according to the invention, said fraction 6 that contains olefins can be used as a feedstock or as an addition of the feedstock in stage e) for alkylation that is described in the description below.

The so-called heavy fraction (or γ), i.e., the fraction whose beginning boiling point is higher than the initial boiling point of fraction B, therefore usually higher than 60° C., is transported via line 7 into a separation zone D (stage d)) such as, for example, a distillation column or any other means of separation that can separate this fraction into two separate fractions:

- a fraction 9 (or η) of the initial boiling point that is approximately equal to the initial boiling point of the fraction γ and by way of example higher than or equal to 60° C. and with a final point of about 90° C. to about 180° C. such as, for example, a 60° C.-180° C. fraction (and even a 60° C.-150° C. or 60° C.-115° fraction). These temperatures that are provided as a reference correspond to boiling points of particular chemical compounds or of azeotropes with minima contained in this fraction. Thus, under atmospheric pressure (about 0.1 MPa), 60° C. is the boiling point of an azeotrope of thiophene with C6 olefins, 115° C. is the boiling point of the pyridine, and 180° C. corresponds to the boiling point of the aniline,
- a heavier fraction 8 (or ϕ) whose initial boiling point corresponds to the final point of the preceding fraction, for example the final point of this fraction ϕ is higher than 115° C. (and even 150° C. or 180° C.).

The heavy fraction (or ϕ) whose initial boiling point is preferably higher than 115° C. or 150° C. and even 180° C. contains only a few olefins. This fraction concentrates the majority (i.e., at least 50% and often at least 80% by weight)

of the basic nitrogen-containing compounds that are contained in the initial gasoline. This fraction is then sent (stage h)) to a unit H for standard hydrodesulfurization that is known to one skilled in the art.

Light fraction 9 (or η) whose boiling points are usually between 60° C. and 180° C. (and even 150° C. or 115° C.) is sent, optionally after mixing with a portion of the olefins that come from line 10 into an alkylation unit E (stage e)). Olefins can be introduced, if necessary, via line 20 into alkylation unit E. Said olefins generally comprise 2 to 10 carbon atoms, often 3 to 7, and preferably 3 to 5 carbon atoms.

The thiophenic compounds and the mercaptans that are contained in the 60° C.-180° C. fraction or the 60° C.-150° C. fraction or the 60° C.-115° C. fraction will in part and often in a majority or generally with more than 50% and even with more than 95% with olefins to form alkyl thiophenes and sulfides according to the following reaction for thiophene:

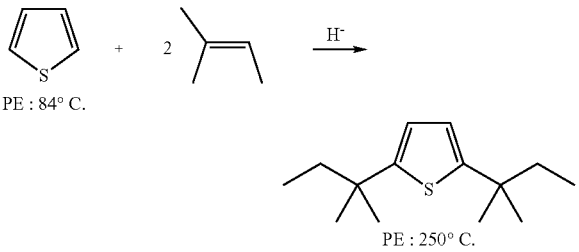

These compounds with higher molecular weights are primarily characterized by higher boiling points than those that they had before alkylation. Thus, the theoretical boiling point of the thiophene, which is under atmospheric pressure of 84° C., is shifted toward 250° C. for the alkyl thiophenes.

This alkylation stage e) is carried out in the presence of an acid catalyst. This catalyst can be equally a resin, a silica-alumina, a zeolite, a clay or any silico-aluminate that exhibits any acidity (optionally provided by the absorption of acids on this substrate). The hourly volumetric flow rate: volume of feedstock that is injected per hour to the volume of catalyst is preferably from about 0.1 to about 10 $h^{-1}$ (liter/liter/hour) and very preferably from about 0.5 to about 4 $h^{-1}$. More specifically, this alkylation stage is usually carried out in the presence of at least one acid catalyst that is selected from the group that is formed by the silica-aluminas, the silicoaluminates, the titanosilicates, the mixed alumina-titanium compounds, the clays, the resins, the mixed oxides that are obtained by grafting at least one organometallic compound that is organosoluble or water-soluble (most often selected from the group that is formed by the alkyls and/or the alkoxy metals of at least one element of groups IVA, IVB, VA, such as titanium, zirconium, silicon, germanium, tin, tantalum, or niobium) on at least one mineral oxide such as alumina (gamma, delta, eta forms, individually or in a mixture), silica, silica-aluminas, titanium silicas, zirconia silicas or any other solid that exhibits any acidity. A particular embodiment of the invention may consist in using a physical mixture of at least two catalysts such as those that are mentioned above in proportions by volume varying from 95/5 to 5/95, preferably 85/15 to 15/85, and very preferably 70/30 to 30/70. It is also possible to use supported sulfuric acid or supported phosphoric acid. In this case, the substrate is usually a mineral substrate, such as, for example, one of those cited above and more particularly silica, alumina or a silica-alumina.

The temperature for this stage is usually from about 30° C. to about 250° C., and most often from about 50° C. to about 220° C., and even about 50° C. to about 190° C. and even 50° C. to 180° C. according to the type of catalyst and/or the acidic strength of the catalyst. Thus, for an organic acid resin of ion-exchange type, the temperature is from about 50° C. to about 150° C., preferably from about 50° C. to about 120° C., and even from about 50° C. to about 110° C. In the case of a zeolite, the alkylation stage is generally carried out at a temperature of between about 50° C. and about 200° C., preferably between about 50° C. and about 180° C., and more preferably between 80° C. and 150° C.

The molar ratio of olefins to the sum (thiophene+thiophenic compounds) present in the fraction is from about 0.1 to about 2000 mol/mol, preferably from about 0.5 to about 1000 mol/mol.

The pressure of this stage is such that the feedstock is in liquid form under temperature and pressure conditions or at a pressure that is usually higher than 0.5 mPa. In a first aspect of the invention, fraction (η'), obtained from alkylation, is sent via line 11 into a distillation column or into any other separation unit F that is known to one skilled in the art to make possible its separation into at least two fractions (stage f)):

- a fraction λ (line 12) of an initial point 60° C. and of a final point of about 90° C. to about 180° C., such as, for example, a 60° C.-180° C. fraction (and even 60° C.-150° C. or 60° C.-100° C.) that is low in thiophenic compounds and mercaptans, and therefore low in sulfur, which is collected via line 12,
- a fraction μ (line 13), whose initial point corresponds to the final point of the preceding fraction, for example the boiling points of this fraction μ are higher than 100° C. (and even 150° C. or 180° C.). This fraction is sent into a hydrocracking unit G (stage g)).

The fraction •, arriving via line 13, will be mixed with the hydrogen that is introduced via line 14. This mixture returns into hydrocracking unit G that contains an acid catalyst. This catalyst can be equally a resin, a zeolite, a clay, a silica-alumina or any silico-aluminate. The hourly volumetric flow rate: volume of feedstock that is injected per hour to the volume of catalyst is preferably from about 0.1 to about 10 $h^{-1}$ (liter/liter/hour) and more preferably from about 0.5 to about 4 $h^{-1}$. More specifically, this hydrocracking stage g) is usually carried out in the presence of at least one acid catalyst that is selected from the group that is formed by the silica-aluminas, the silicoaluminates, the titanosilicates, the mixed alumina-titanium compounds, the clays, the resins, the mixed oxides that are obtained by grafting at least one organometallic compound that is organosoluble or water-soluble (most often selected from the group that is formed by the alkyls and/or alkoxy metals of at least one element of groups IVA, IVB, or VA, such as titanium, zirconium, silicon, gerrnanium, tin, tantalum, or niobium) on at least one mineral oxide, such as alumina (gamma, delta, or eta forms, individually or in a mixture), silica, silica-aluminas, titanium silicas, zirconia silicas or any other acidic solid. The catalyst that is used can also contain metals, generally in the form of sulfides, such as, for example, non-noble metals of group VIII and/or metals of group VIB. Among these metals, those that are most often used are nickel, cobalt, molybdenum and tungsten. A particular embodiment of the invention can consist in using a physical mixture of at least two catalysts such as those that are mentioned above in proportions per unit volume that vary from 95/5 to 5/95, preferably 85/15 to 15/85, and very preferably 70/30 to 30/70. It is also possible to use supported sulfuric acid or supported phosphoric acid. In this case, the substrate is usually a mineral substrate such as, for example, one of those cited above, and more particularly, silica, alumina or a silica-alumina.

The temperature for this stage is from about 30° C. to about 500° C., often from about 60° C. to about 400° C., and most often from about 100° C. to about 400° C., and even about 200° C. to about 400° C., according to the type of catalyst or the acidic strength of the catalyst. Thus for a Y zeolite, the temperature is from about 80° C. to about 400° C., preferably from about 100° C. to about 380° C., and even about 130° C. to about 360° C. or even 200° C. to 350° C.

For a silica, an alumina or a silica-alumina, the temperature is generally between about 200° C. and about 400° C., preferably between about 220° C. and about 400° C., more preferably between about 240° C. and about 390° C.

In the case of supported sulfuric acid or phosphoric acid, the hydrocracking temperature is generally between about 200° C. and about 400° C., preferably between about 220° C. and about 390° C. and more preferably between about 220° C. and 380° C.

Thus, the hydrocracking is preferably carried out at a temperature of higher than 200° C., regardless of the acidic solid used, whereas the alkylation stage is carried out at a temperature that is preferably less than 200° C. and more preferably less than 190° C. and even 180° C., regardless of the nature of the acidic solid.

This hydrocracking unit will transform the dialkyl thiophenes, previously formed in alkylation unit E of stage e), into thiophene and light isoparaffins or will isomerize the dialkyl thiophenes. Actually, these dialkyl thiophene compounds are compounds that are heavily sterically encumbered and where the sulfur is not very sensitive to the hydrogenolysis. After hydrocracking or isomerization, the thiophene that is formed is then easily hydrogenolyzed by means of a standard hydrotreatment that is known to one skilled in the art during subsequent stage h). The products at the outlet of hydrocracking unit G (stage g)) are sent, via line 15, after mixing with fraction $\phi$ that is defined above and that is obtained from line 8 and hydrogen that is obtained from line 16 in a standard hydrotreatment zone H (stage h)). Hydrotreatment stage h) is usually carried out in the presence of a standard hydrotreatment catalyst that is preferably selected from the group that is formed by the catalysts that comprise a mineral substrate (such as, for example, silica, alumina or a silica-alumina) and that comprise at least one preferably non-noble metal of group VIII (for example, nickel, cobalt) and/or at least one metal of group VIB (for example, molybdenum, tungsten). Most often, the catalyst will comprise an alumina-based substrate, at least one non-noble metal of group VIII, and at least one of group VIB. For example, a catalyst that comprises cobalt and molybdenum on an alumina substrate will be used.

The total gasoline, resulting from the mixing of suitable fractions, i.e., fractions that are fed by lines 6, 12, and 17, usually contains less than 50 ppm by weight of sulfur (it often contains less than 40 ppm by weight of sulfur).

This process makes it possible to treat the feedstocks that contain nitrogen-containing compounds contrary to the processes according to the prior art. The fraction point of stage d) is suitable based on the content of basic nitrogen-containing compounds allowed on the acid catalyst of stage e). These basic nitrogen-containing compounds thus are found in the heavy fraction that exits zone D for separation of stage d) via line 8.

The heavier nitrogen-containing compounds, of which the lightest is pyridine, have a boiling point of higher than 110° C. They are therefore eliminated by, for example, distillation (stage d), line 8). They are found at the bottom of the column and are sent directly to the hydrotreatment (stage h)).

Basic nitrogen-containing compounds are then removed, almost in their entirety, from feedstock $\eta$ that is then sent to the alkylation (preferably a 60° C.-180° C. fraction or a 60° C.-150° C. fraction, or a 60° C.-115° C. fraction), preferably without it having been necessary to resort to an acid washing or a guard bed. However, the scope of this invention would not be exceeded by carrying out a treatment of the feedstock before its introduction into the alkylation zone, making it possible to eliminate the nitrogen-containing compounds and in particular the basic nitrogen-containing compounds that it optionally also contains.

This process thus offers advantages relative to the processes of the prior art:

with regard to problems linked to nitrogen-containing compounds: in particular in the case of particular implementations described in connection with FIG. 1, it is no longer essential to treat the feedstock in advance to eliminate the basic nitrogen-containing compounds, for example, by an acid washing and/or by an adsorption in a guard bed before its introduction into the alkylation zone since these compounds are separated by, for example, distillation, and since the fraction that is introduced into the alkylation zone no longer contains virtually any of them. A possible elimination of the residual nitrogen-containing compounds, for example by adsorption or by washing, would furthermore be facilitated by the low concentration of the latter in the fraction that is to be treated according to the invention.

With regard to the problems linked to diolefins: thus, for example in the process described by U.S. Pat. No. 6,048,451, the fraction is sent directly to acid-catalyst alkylation. One skilled in the art knows, however, that the diolefins have the unfortunate tendency to polymerize and to make gums, thus clogging the reactors and the exchangers, which is not the case in the implementations described in connection with, for example, FIG. 1, since these diolefins are hydrogenated selectively before the alkylation stage.

With regard to the problems linked to olefins: according to the teaching of U.S. Pat. No. 6,048,45 1, the entire petroleum fraction is sent into alkylation, therefore the light olefins will, in the presence of the acid catalyst employed for the alkylation, at least partially dimerize. This dimerization will be reflected in the effluent by a reduction of the octane number. In the process according to the invention, however, before the alkylation, a PI-60° C. fraction (PI=initial boiling point) is separated, which is high in olefins and more particularly in light olefins (in particular those of C5). Therefore, the problem of dimerization does not arise. Actually, the olefins that remain in the 60° C.-180° C. fraction have longer chain lengths, therefore lower dimerization speeds, hence a weaker impact on the octane number. The process of this invention thus makes it possible to obtain lower octane losses than those described in U.S. Pat. No. 6,048,451.

With regard to the problems linked to the hydrotreatment of alkyl thiophenes: certain alkyl thiophenes are compounds that are difficult to hydrogenolyze. The process according to the invention thus offers the advantage of their transformation by hydrocracking and/or isomerization into more easily hydrogenolyzable compounds.

EXAMPLES

The examples-below illustrate the advantage of an implementation of this invention and in particular of the hydrocracking stage (stage g) before the hydrotreatment stage (stage h). It has therefore been compared to iso-performance in hydrodesulfurization of heavy fractions that are obtained from two distillation stages (stages d and f) according to two different embodiments: the first not in accordance with the invention not comprising a hydrocracking stage and the second according to this invention comprising a hydrocracking stage.

The first embodiment (I), not in accordance with this invention, does not comprise the hydrocracking stage. In this case, the effluent that exits from the alkylation zone (stage e) is sent into a separation zone (stage f) from which a light fraction and a heavy fraction that is sent directly into a hydrotreatment stage (stage h) are recovered.

The second embodiment (II), according to this invention, comprises a hydrocracking stage. In this case, the effluent that exits from the alkylation zone (stage e) is sent into a separation zone (stage f) from which a light fraction and a heavy fraction that is sent into a hydrocracking stage (stage g) are recovered. The effluent that is obtained from the hydrocracking stage is then sent into the hydrotreatment zone (stage h).

In the two cases, the feedstock that is used has first been hydrogenated (stage a) then distilled in three fractions (stages b and d). The core fraction is next alkylated (stage e) and then fractionated (stage f). In the example that is not in accordance with this invention, the heavy fraction that is obtained from stage f is mixed with the heavy fraction that is obtained from stage d, then the entire flow that is obtained is hydrotreated. In the example according to this invention, the heavy fraction that is obtained from stage f is first hydrocracked before being mixed with the heavy fraction that is obtained from stage d, then the entire flow that is obtained is hydrotreated. For each of the stages, the characteristics of the feedstocks, effluents as well as applied operating conditions are described below. The numbering of fractions corresponds to that mentioned in FIG. 1.

Stage a

The feedstock, whose characteristics appear in Table 1, was treated with a commercial catalyst sold by the AXENS Company under the commercial reference HR945 under 25 bar of pressure total, with a VVH of 6 $h^{-1}$, a ratio of hydrogen/feedstock flow rates of 5 1/1 and a temperature of 170° C. The characteristics of the effluent that is obtained also appear in Table 1.

TABLE 1

Characteristics of the Feedstock and the Effluent During Stage a:

| | Feedstock | Effluent |
|---|---|---|
| Distillation Interval | PI - 220° C. | PI - 220° C. |
| $d_{15}$ | 0.7573 | 0.7589 |
| Sulfur (ppm) | 440 | 452 |
| Mercaptans (ppm) | 19 | 9 |
| MAV | 9.1 | 0.8 |
| NBr | 60.0 | 59.5 |
| RON | 92.6 | 92.5 |
| MON | 81.0 | 81.0 |

Where:
MAv is the level of maleic acid (Maleic Anhydride Value according to English terminology) that makes it possible, according to a technique that is known to one skilled in the art, to estimate the level of diolefins,
NBr is the bromine number that makes it possible, according to a technique that is known to one skilled in the art, to estimate the level of olefins that are present,
RON is the research octane number (Research Octane Number according to English terminology),
MON is the motor octane number (Motor Octane Number according to English terminology).

This stage makes it possible to eliminate the diolefins so as to prevent any clogging of the unit and to keep the catalysts downstream. It also makes it possible to increase the weight of light mercaptans.

Stages b and d

The effluent of stage a is distilled in three fractions whose characteristics appear in Table 2.

TABLE 2

Characteristics of the Feedstock and Three Fractions Obtained During Stages b and d

| | Feedstock | Fraction β | Fraction η | Fraction φ |
|---|---|---|---|---|
| Distillation Interval | PI - 220° C. | PI - 55° C. | 55–140° C. | 140–220° C. |
| $d_{15}$ | 0.7589 | 0.6508 | 0.7368 | 0.8466 |
| Yield (% by Weight) | 100 | 19 | 46 | 35 |
| Sulfur (ppm) | 452 | 3 | 311 | 886 |
| Mercaptans (ppm) | 9 | 0 | 9 | 15 |
| NBr | 59.5 | 115.0 | 63.5 | 18.5 |

where PI is the initial boiling point that is typical of stabilized gasolines

The light fraction (fraction β or fraction 4 according to FIG. 1) contains almost no sulfur and no longer contains mercaptans. It can then be directly integrated into the gasoline pool. The intermediate fraction (fraction η or fraction 9) is sent into the alkylation stage (stage e), and the heavy fraction (fraction φ or fraction 8) is sent into the hydrotreatment stage (stage h).

Stage e

Fraction η (or fraction 9), whose characteristics are incorporated in Table 3, was treated with an ion-exchange resin-type catalyst with a base of Amberlyst 15 under 20 bar of total pressure, with a VVH of 1 $h^{-1}$ and a temperature of 110° C. The characteristics of the effluent (fraction 11) that is obtained also appear in Table 3.

TABLE 3

Characteristics of the Feedstock and the Effluent During Stage e

| | Feedstock | Effluent |
|---|---|---|
| Distillation Interval | 55–140° C. | 55–240° C. |
| $d_{15}$ | 0.7368 | 0.7642 |
| Sulfur (ppm) | 311 | 315 |
| NBr | 63.5 | 54.0 |

In this stage, the primary reaction is the alkylation of thiophene and methylthiophene-type compounds. Parasitic hydrocarbon alkylation reactions result in a modification of the distillation interval of the feedstock.

Stage f

The effluent of stage e is distilled in two fractions whose characteristics appear in Table 4.

TABLE 4

Characteristics of the Feedstock and the Two Fractions That Are Obtained During Stage e)

| | Feedstock | Fraction λ | Fraction μ |
|---|---|---|---|
| Distillation Interval | 55–240° C. | 55–100° C. | 100–240° C. |
| $d_{15}$ | 0.7642 | 0.6975 | 0.8730 |
| Yield (% by Weight) | 100 | 62 | 38 |

TABLE 4-continued

| Characteristics of the Feedstock and the Two Fractions That Are Obtained During Stage e) | | | |
|---|---|---|---|
| | Feedstock | Fraction λ | Fraction μ |
| Sulfur (ppm) | 315 | 19 | 791 |
| NBr | 54.0 | 67.5 | 32 |

The sulfur content of the light fraction (fraction γ or fraction 12) is low enough that this fraction is directly integrated into the gasoline pool. The heavy fraction (fraction μ or fraction 13) requires a hydrotreatment. In the case that is not in accordance with this invention, this fraction 4 is mixed with fraction ϕ (fraction 8) that is obtained from stage d) before being hydrotreated. In the case according to this invention, fraction μ or fraction 13 is hydrocracked before being mixed with fraction ϕ, then hydrotreated.

Stage g) (True Case)

Fraction μ, whose characteristics are incorporated in Table 5, was treated with an acid catalyst that consists of 10% Y zeolite and 90% alumina, under a pressure of 20 bar, a temperature of 350° C., a ratio of hydrogen/feedstock flow rates of 150 liter/liter, and a VVH of 1 $h^1$. Under these conditions, the primary reactions that are observed are reactions of isomerization and cracking of heavy alkylthiophenes. The characteristics of the effluent (fraction 15) that is obtained also appear in Table 5.

TABLE 5

| Characteristics of the Feedstock and the Effluent During Stage g | | |
|---|---|---|
| | Feedstock | Effluent |
| Distillation Interval | 100–240° C. | 80–220° C. |
| $d_{15}$ | 0.8730 | 0.8528 |
| Sulfur (ppm) | 791 | 776 |
| NBr | 32 | 30.5 |

During this stage, the sulfur-containing compounds with a high boiling point that are obtained from the alkylation of thiophenic compounds during stage e are isomerized and lightly cracked, which facilitates their hydrogenolysis during the hydrotreatment stage (stage h).

Stage h

Fraction ϕ (obtained from stage d, fraction 8) is mixed directly with fraction μ (obtained from stage f, fraction 13) in the embodiment that is not in accordance with this invention and with the hydrocracked fraction (obtained from stage g, fraction 15) in the embodiment according to this invention. In mixtures (16), the fraction ϕ represents 67% and the hydrocracked fraction (fraction 15, FIG. 1) or not represents 33%. The characteristics of the two mixtures to be hydrotreated appear in Table 6.

Feedstock 1 is not in accordance with the invention, i.e., it has not undergone hydrocracking stage g). Feedstock II is in accordance with the invention, i.e., it has undergone hydrocracking stage g).

TABLE 6

| Characteristics of the Feedstocks That are Treated in Stage h | | |
|---|---|---|
| | Feedstock I | Feedstock II |
| Embodiment | Not in Accordance | In Accordance |
| Distillation Interval | 100–240° C. | 80–220° C. |
| $d_{15}$ | 0.8554 | 0.8487 |

TABLE 6-continued

| Characteristics of the Feedstocks That are Treated in Stage h | | |
|---|---|---|
| | Feedstock I | Feedstock II |
| Sulfur (ppm) | 854 | 849 |
| NBr | 23.0 | 22.5 |

Generally, two feedstocks I and II exhibit very closely related characteristics. In the two cases, the catalyst that is used during the hydrotreatment stage is a catalyst based on cobalt sulfide and molybdenum deposited on alumina. The operating conditions that are applied during the hydrotreatment according to the feedstocks as well as the characteristics of the effluents that are obtained are categorized in Table 7.

TABLE 7

| Operating Conditions and Characteristics of Effluents (17) Obtained During Stage h | | |
|---|---|---|
| | First Embodiment Not in Accordance with the Invention | Second Embodiment According to the Invention |
| Hydrocracking Stage | No | Yes |
| Feedstock | I | II |
| T (° C.) | 310 | 280 |
| $P_{total}$ (bar) | 20 | 20 |
| VVH (l/l/h) | 2 | 4 |
| $H_2$/HC (l/l) (Hydrotreatment) | 300 | 300 |
| $d_{15}$ | 0.8591 | 0.8454 |
| $S_{effluent}$ (ppm) | 20 | 20 |
| $NBr_{effluent}$ | 7.0 | 14.0 |

These results show that by operating without a hydrocracking stage (case of the first embodiment), the operating conditions that are necessary for the hydrotreatment stage to reach a sulfur content of 20 ppm in the effluents are very strict (high temperature and low VVH). Taking into account these operating conditions, the hydrodesulfurization is accompanied by a high hydrogenation of the olefins that are present. With the hydrocracking stage prior to the hydrotreatment stage, the sulfur-containing compounds with a high boiling point that are formed during the alkylation stage (stage e) are isomerized and a little cracked, which facilitates their hydrogenolysis in the hydrotreatment stage. Thus, to reach the same sulfur content in the effluents, the operating conditions that are applied during the hydrotreatment stage are clearly milder.

Finally, all the flows that exit from this process diagram, namely fraction β (4) obtained from stage b, fraction λ (12) that is obtained from stage f, and the hydrotreated effluent that is obtained from stage h (17) are mixed. The characteristics of the mixture according to the two embodiments appear in Table 8.

TABLE 8

| Characteristics of the Mixtures | | |
|---|---|---|
| | Mixture I | Mixture II |
| Embodiment | Not in Accordance | In Accordance |
| Distillation Interval | PI - 240° C. | PI - 220° C. |
| $d_{15}$ | 0.7735 | 0.7663 |
| Sulfur (ppm) | 17 | 16 |
| NBr | 45.0 | 48.0 |

TABLE 8-continued

| Characteristics of the Mixtures | | |
|---|---|---|
| | Mixture I | Mixture II |
| RON | 90.4 | 91.1 |
| MONDAY | 80.2 | 80.7 |

Relative to the feedstock input into stage a, in the two embodiments, the overall desulfurization is about 96%. In mode II according to this invention (with hydrocrackine stage g), the associated octane loss is 0.9 in ΔFON(=Δ(RON+MON)/2) whereas in the mode I that is not in accordance, the associated octane loss is 1.5 in ΔFON, i.e., clearly higher.

In summary, this invention relates to a process for desulfurization of a feedstock that contains thiophene or thiophenic compounds that make it possible to work on a feedstock that optionally contains nitrogen-containing compounds that comprise the following stages:

The feedstock is generally selected from the group that consists of the effluents of a catalytic cracking unit, a steam-cracking unit or a coke production unit (coking according to English terminology).

The alkylation catalyst is preferably an acid catalyst that is selected from the group that consists of the phosphoric acids or sulfuric acids that are supported by the zeolites, the silica-aluminas and the ion-exchange resins.

Preferably also, hydrocarbon-containing fractions with boiling points of less than 350° C. and often less than 275° C. and that preferably contain both olefins, preferably at least 3% by weight and at most 90% by weight, and sulfur, preferably at least 5 ppm and usually at most 3% by weight, are desulfurized when the following stages are linked together:

at least one alkylation unit, at least one distillation unit, at least one hydrocracking unit, and at least one hydrotreatment unit.

Preferably also, the distillation is carried out after the alkylation, but also the distillation can be carried out at the same time as the alkylation in a catalytic column. It is also possible to carry out a distillation with the alkylation stage that then makes it possible to greatly reduce the content of nitrogen-containing compounds in the feedstock that is introduced into the alkylation unit.

The hydrotreatment unit can be located after at least one distillation stage and before at least one hydrocracking stage.

Preferably also, the thiophene and/or the thiophenic compounds are alkylated on an acid catalyst in the presence of olefins that have at least 2 carbon atoms and preferably at most 10 carbon atoms; whereby the molar ratio of olefin to the thiophene+thiophenic compounds sum is generally between 0.1 to 2000 mol per mol and preferably 0.5 to 1000 mol/mol, whereby the pressure of the alkylation unit is more particularly at least 0.5 MPa. Often, the pressure of this stage is from about 0.5 MPa to about 10 MPa and most often from about 1 MPa to about 5 MPa.

The hydrocracking catalyst is preferably an acid catalyst that is selected from the group that consists of zeolites, silica-aluminas, clays and acid resins.

The invention claimed is:

1. A process for desulfurization of a feedstock containing thiophene and/or thiophenic compounds, said process comprising the following stages:

e) in alkylation stage (e) introducing said feedstock into alkylation zone E, and alkylating thiophene and/or thiophenic compounds by at least one olefin, f) fractionating in a fractionation zone F at least a portion of resultant effluent (fraction η') from alkylation stage e) into at least two fractions: a light fraction (λ) low in sulfur and a heavy fraction (μ) that is high in alkyl thiophenes and in alkyl thiophenic compounds, g) passing at least a portion of the heavy fraction (μ) obtained from fractionation stage f), to a hydrocracking zone G, to hydrocrack alkyl-thiophenes and alkyl-thiophenic compounds contained in said fraction, h) passing of at least a portion of the resultant hydrocracked effluent obtained from hydrocracking zone G, to a hydrotreatment zone H to recover a hydrocracked fraction low in sulfur.

2. A process according to claim 1 comprising before alkylation stage e) at least one stage for fractionation of the feedstock containing thiophene and/or thiophenic compounds into at least three fractions:

a heavy fraction that is sent directly to hydrotreatment zone h), a light fraction that contains light olefins that have less than 7 carbon atoms in their molecule, an intermediate fraction that contains thiophene and/or thiophenic compounds that are sent into alkylation stage e).

3. A process according to claim 1 that comprises before alkylation stage e)

a fractionation stage b) in which the feedstock is introduced into a fractionation zone from which are recovered at least one light fraction and at least one heavy fraction, a stage d) for fractionation of heavy fraction y that is obtained from stage b) into a light fraction η that is sent into alkylation stage e) and at least one heavy fraction ϕ that is sent into hydrotreatment stage h).

4. A process according to claim 3, in which light fraction β that is obtained from stage b) is sent into a gas/liquid separation zone (stage c) starting from which a gaseous fraction and a liquid fraction containing olefins are recovered, whereby a fraction that comprises 0 to 100% of said olefins is then sent to alkylation stage e).

5. A process according to claim 1, in which the olefin that is used in alkylation stage e) was at least partially present in the feedstock that contains thiophene and/or thiophenic compounds.

6. A process according to claim 1, in which at least a portion of the olefin that is used in alkylation stage e) is obtained from an outside olefin source.

7. A process according to claim 1, in which the feedstock comprises an effluent from a catalytic cracking unit, a steam-cracking unit or a coke production unit.

8. A process according to claim 1, in which alkylation stage e) is carried out in the presence of an acid catalyst for alkylation.

9. A process according to claim 1, in which hydrocracking stage g) is carried out in the presence of an acid hydrocracking catalyst.

10. A process according to claim 1, in which hydrotreatment stage h) is carried out in the presence of a hydrotreatment catalyst comprising a mineral substrate, at least one non-noble metal of group VIII and at least one metal of group VIB.

11. A process of desulfurization according to claim 1, in which the feedstock is a hydrocarbon-containing fraction with a boiling point of less than 350° C. and that contains both olefins, at least 3% by weight and at most 90% by weight, and sulfur, at least 5 ppm and at most 3% by weight.

12. A process according to claim 1 for which the thiophene and/or the thiophenic compounds are alkylated on an acid catalyst in the presence of olefins that have at least 2 carbon atoms and at most 10 carbon atoms; whereby the molar ratio of olefin to the sum of thiophene + thiophenic compounds is between 0.1 to 2000 mol per mol.

13. A process according to claim 1 for which the pressure of the alkylation unit is at least 0.5 MPa.

14. A process according to claim 1 for desulfurization of a feedstock that contains thiophene or thiophenic compounds that also comprise:

a) a stage for selective hydrogenation carried out under conditions to reduce the starting diolefin content of the feedstock, b) a fractionation stage in a distillation zone of the resultant effluent from stage a) into a heavy fraction containing sulfur and into a lighter fraction that contains thiophene and/or thiophenic compounds, c) a stage for alkylation of thiophene and/or thiophenic compounds that are present in the lighter fraction that is obtained from stage b) by at least one olefin, d) a stage before alkylation stage e) in which the feedstock that is introduced into the alkylation zone (e) is first treated to eliminate at least a portion of basic nitrogen-containing compounds within said change.

15. A process according to claim 14, in which to eliminate at least in part said basic nitrogen-containing compounds, the procedure is performed in an acidic medium.

16. A process according to claim 14, in which the elimination of at least a portion of the basic nitrogen-containing compounds is carried out downstream or upstream from fractionation stage b).

17. A process according to claim 8, wherein the acid catalyst for alkylation comprises at least one of a supported phosphoric acid, a sulfuric acid, a zeolite, a silica-alumina and an ion-exchange resin.

18. A process according to claim 9, wherein the acid hydrocracking catalyst comprises at least one of a zeolite, a silica-alumina, a clay or an acid resin.

19. A process according to claim 14, further comprising desulfurizing said heavy fraction from step (b).

* * * * *

UNITED STATES PATENT AND TRADEMARK OFFICE

CERTIFICATE OF CORRECTION

PATENT NO. : 7,344,635 B2
APPLICATION NO. : 10/503807
DATED : March 18, 2008
INVENTOR(S) : Patrick Briot It is certified that error appears in the above-identified patent and that said Letters Patent is hereby corrected as shown below:

On the title page item (54) and Col. 1, lines 3-4, reads "STREAM CRACKING" should read -- STEAM-CRACKING --
Column 12, line 34, reads "fraction y" should read -- fraction $\gamma$ --

Signed and Sealed this

Sixteenth Day of December, 2008

JON W. DUDAS
*Director of the United States Patent and Trademark Office*